US006473674B1

(12) United States Patent
Okada

(10) Patent No.: US 6,473,674 B1
(45) Date of Patent: Oct. 29, 2002

(54) METHOD AND DEVICE FOR DETECTING MULTIPLE FEED

(75) Inventor: Shinya Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 247 days.

(21) Appl. No.: 09/649,578

(22) Filed: Aug. 29, 2000

(30) Foreign Application Priority Data

Aug. 31, 1999 (JP) ..... 11-245898

(51) Int. Cl.[7] ..... G06F 7/00
(52) U.S. Cl. ..... 700/227
(58) Field of Search ..... 700/227, 235; 271/258.01, 259, 263, 265.01, 265.02, 265.04

(56) References Cited

U.S. PATENT DOCUMENTS 4,395,111 A * 7/1983 Takahashi et al. ..... 355/14 R
4,714,946 A * 12/1987 Bajgert et al. ..... 355/75
4,922,110 A * 5/1990 Melcher ..... 250/556
4,962,393 A * 10/1990 Fulton et al. ..... 346/150
5,226,640 A * 7/1993 Puzey ..... 271/107
5,246,219 A 9/1993 Watkiss
5,318,286 A * 6/1994 Makiura et al. ..... 271/9
5,831,748 A 11/1998 Tsukada et al.
5,861,646 A * 1/1999 Czesnik et al. ..... 250/559.4
6,053,495 A * 4/2000 Hara et al. ..... 271/263
6,105,959 A * 8/2000 Miyata et al. ..... 271/263

FOREIGN PATENT DOCUMENTS

EP 1 081 074 A2 * 3/2001 ..... B65H/7/12
EP 1 081 074 A3 * 10/2001 ..... B65H/7/12

* cited by examiner

*Primary Examiner*—Donald P. Walsh
*Assistant Examiner*—Michael E. Butler
(74) *Attorney, Agent, or Firm*—Nath & Associates PLLC; Gary M. Nath; Harold L. Novick

(57) ABSTRACT

A light emitting sensor emits light toward sheets carried along a carriage path and the quantity of light transmitted through each to the sheets is detected by a light receiving sensor. A predetermined sampling number of electric signals indicative of light quantity detected by the light receiving sensor is stored in a memory. A histogram of the light quantities stored in the memory is created. A light quantity corresponding to a maximum frequency for an underlying portion of the sheets is detected based on the created histogram. A multiple feed of the sheets is detected based on a variation in the light quantity of the maximum frequency for the underlying portion.

8 Claims, 17 Drawing Sheets

FIG. 5

| LIGHT TRANSMISSION QUANTITY | FREQUENCY |
|---|---|
| 115 | 2 |
| 116 | 5 |
| 117 | 3 |
| 118 | 5 |
| 119 | 7 |
| **120** | 23 |
| 121 | 11 |
| 122 | 7 |
| 123 | 10 |
| 124 | 1 |

FIG. 7

| LIGHT TRANSMISSION QUANTITY | FREQUENCY |
|---|---|
| 62 | 1 |
| 63 | 3 |
| 64 | 4 |
| 65 | 9 |
| 66 | 13 |
| 67 | 12 |
| **68** | 24 |
| 69 | 6 |
| 70 | 0 |
| 71 | 0 |

EXAMPLE 1) WHERE THE FREQUENCY AT THE LIGHT TRANSMISSION QUANTITY (100) FOR THE UNDERLYING PORTION IS 50 AND THE FREQUENCY AT THE LIGHT TRANSMISSION QUANTITY (40) FOR THE PRINTED PORTION IS 50

( (40×50)+(100×50) )/100=70

ASSUMING THAT EACH OF THE LIGHT TRANSMISSION QUANTITIES BECOMES 1/2 AT THE TIME OF MULTIPLE FEED, THE AVERAGE OF THE VARIATIONS IS "35"

( (20×50)+(50×50) )/100=35

EXAMPLE 2) WHERE THE FREQUENCY AT THE LIGHT TRANSMISSION QUANTITY (100) FOR THE UNDERLYING PORTION IS 50 AND THE FREQUENCY AT THE LIGHT TRANSMISSION QUANTITY (20) FOR THE PRINTED PORTION IS 50

EXAMPLE 3) WHERE THE FREQUENCY AT THE LIGHT TRANSMISSION QUANTITY (100) FOR THE UNDERLYING PORTION IS 80 AND THE FREQUENCY AT THE LIGHT TRANSMISSION QUANTITY (40) FOR THE PRINTED PORTION IS 20

EXAMPLE 4) WHERE THE FREQUENCY AT THE LIGHT TRANSMISSION QUANTITY (100) FOR THE UNDERLYING PORTION IS 60 AND THE FREQUENCY AT THE LIGHT TRANSMISSION QUANTITY (40) FOR THE PRINTED PORTION IS 40

METHOD AND DEVICE FOR DETECTING MULTIPLE FEED

BACKGROUND OF THE INVENTION

1. Field of the Invention

This invention relates to a multiple feed detection device for detecting a feed of two or more overlapped sheets (multiple feed) when sheets are carried along a carriage path, and more particularly to a method and a device for detecting a multiple feed suitable for the multiple feed detection of prints.

2. Description of the Related Art

A collator shown in FIGS. 8, 9A, and 9B is known as an apparatus for collating a plurality of different prints by overlapping them one by one from the first page to make bundles of a desired number of copies of the prints.

FIG. 8 shows an external view illustrating an entire collator, FIG. 9A shows a partially enlarged sectional view of each bin taken from FIG. 8, and FIG. 9B shows a view illustrating each bin as viewed in the direction indicated by the arrow A in FIG. 9A. In FIG. 8, arrows indicate the flow of sheets for each bin.

A collator 1 comprises a plurality of bins (10 bins in an example of FIG. 8) 2 in which different prints (sheets) are to be set. The bins 2 ($\mathbf{2}_1$ to $\mathbf{2}_{10}$) are arranged in parallel in spaced apart relation provided vertically with respect to a body 3 and disposed to be protruded with a predetermined distance from the front surface of the body 3.

A sheet discharge tray 5 for collating and discharging prints 4 which are fed from each bin 2 one by one is disposed to be protruded with a predetermined distance from the front surface of the body 3 at the lowest part of the body 3. A carriage mechanism is provided inside the body 3, e.g., carrier rollers or carrier belts for carrying the prints 4 fed from each bin 2 onto the sheet discharge tray 5.

Each bin 2 comprises a sheet feed base 6 on which the prints 4 are set. The sheet feed base 6 includes a fixed part 6*a* and a movable part 6*b* which is vertically movable by a shift mechanism driven by a motor (not shown). A sheet-detecting sensor 7 for detecting any presence of the prints 4 to be set, e.g., a reflector-type sensor, is disposed in the movable part 6*b*. A sheet feed fence 8 movable in accordance with the size of the prints 4 to be set is disposed on the sheet feed base 6. The sheet feed fence 8 in FIG. 9B is provided to be fixed at the right side and movable in accordance with the size (width) of the prints at the left side.

A sheet feed roller 9 and a handling plate 10 for carrying the prints 4 set on the sheet feed base 6 one by one from the top to the body 3 are provided to be opposed to one another in each bin 2. Auxiliary rollers 11 for keeping the prints 4, e.g., from being curled, are disposed at both sides of the sheet feed roller 9. The rotation axis 12 of the sheet feed roller 9 and the auxiliary rollers 11 is connected through a sheet feed clutch 13 to a main motor (drive motor 26). The sheet feed roller 9 and the auxiliary rollers 11 rotate by means of drive of the main motor in a clockwise direction in FIG. 9A.

Multiple feed sensors 15 as a sheet detector for detecting a multiple feed of the prints 4 to be fed are disposed around a carriage path between the sheet feed roller 9 of each bin 2 and the carriage mechanism of the body 3.

The multiple feed sensors 15 are constituted by a transmission-type of optical sensors comprising a light emitting sensor 15*a* and a light receiving sensor 15*b*. The light emitting sensor 15*a* is, for example, constituted by a light emitting diode, a laser diode, or a lamp. The light emitting sensor 15*a* is disposed at a predetermined distance apart from the carriage path 16 along which the prints 4 are fed.

The light receiving sensor 15*b* is, for example, constituted by a photodiode. The light receiving sensor 15*b* is disposed to be opposed to the light emitting sensor 15*a* at a predetermined distance apart from the carriage path 16, e.g., in an equally spaced apart relation between the light emitting sensor 15*a* and the carriage path 16 such that the carriage path 16 on which the prints 4 are fed is sandwiched between the sensors.

At the position of the multiple feed sensor 15, if the prints 4 are not carried, the light emitted from the light emitting sensor 15*a* is directly received by the light receiving sensor 15*b*, whereas if the prints 4 are carried, the light transmitted through the prints 4 is received by the light receiving sensor 15*b*.

In the collator 1 as constituted above, when the prints 4 having pages 1 to 10 are respectively set to the bins $\mathbf{2}_1$ to $\mathbf{2}_{10}$ in order, e.g., the prints 4 of page 1 to $\mathbf{2}_1$, the prints 4 of page 2 to $\mathbf{2}_2$, the prints 4 are fed one by one subsequently from the bin $\mathbf{2}_1$ positioned in the highest part, and discharged onto the sheet discharge tray 5. This allows the collated prints 4 to be discharged as a copy of the pages 1 to 10 onto the sheet discharge tray 5.

Each of the prints 4 set in each of the bins 2 is fed inside the body 3 through the following states: that is, the state where it is approaching carrier rollers 17 of the carriage mechanism of the body 3 as shown in FIG. 01A, the state where it has reached the carrier rollers 17 and a loose is then produced as shown in FIG. 10B, the state where it is pressed by the sheet feed roller 9 and the carrier rollers 17 so that the position of it passing between the multiple feed sensors 15 is fixed as shown in FIG. 10C, and the state where the end thereof leaves the sheet feed roller 9 and thereby rises upward.

In the collator 1 as constituted above, conventionally, when detection is conducted for the multiple feed of the prints 4 fed from each of the bins 2, a detection method has been employed in which the maximum value of the light transmission quantity of the prints 4 being passed is measured while the prints 4 pass through between the multiple feed sensors 15, and the maximum value is compared to a reference value.

However, in the conventional method as stated above, when the maximum value of the light transmission quantity of the prints 4 being passed is measured, a slack of the prints may develop as shown in FIG. 10B, and a springing of the prints may develop as shown in FIG. 10D. Therefore, the position of the sheet passing between the multiple feed sensors deviates from a predetermined position, thereby causing an increase in the light transmission quantity compared to the real one.

FIG. 11 illustrates an example of the light transmission quantity of the prints at the time of the sheet feed. This shows that when the slack or springing of the prints 4 develops as shown in FIGS. 10B and 10D, the light transmission quantity of the prints 4 drastically changes as shown in respective regions (i) and (ii) in FIG. 11 so that it cannot be stable.

Therefore, the conventional method as stated above may have caused a problem in that if the light transmission quantity of the prints 4, when the slack or springing of the prints 4 develops as shown in FIGS. 10B and 10D, is measured as the maximum value, the measured value is not less than a reference value even when a multiple feed really occurs, thereby causing misdetection.

Instead of the above method, it is known to use a method in which an average value of the light transmission quantity for a certain extent in area of the print is calculated and then the calculated average value is compared with a reference value.

However, in this method, when the level of the darkness of the printed portion is high or the rate of the printed portion to the whole area is high, as will be explained in the following examples 1 to 4 (FIGS. 12 to 15), a difference between the average values of the single feed and the multiple feed becomes smaller, thus causing a lower degree of accuracy for the detection.

EXAMPLE 1

As shown in FIG. 12, if the frequency at the light transmission quantity of 100 for the underlying portion of the prints is 50 and the frequency at the light transmission quantity of 40 for the printed portion of the prints is 50 at the time of the single feed, the average is 70. Assuming that the light transmission quantity for the underlying portion and the printed portion at the time of multiple feed may become a half compared with the single feed under such a condition, the average of the variations is 35. At this time, the variation in the light transmission quantity of the underlying portion is 50 and that of the printed portion is 20. This example 1 is for the case where the frequencies of the underlying portion and the printed portion of the prints are identical.

EXAMPLE 2

As shown in FIG. 13, if the frequency at the light transmission quantity of 100 for the underlying portion of the prints is 50 and the frequency at the light transmission quantity of 20 for the printed portion of the prints is 50 at the time of the single feed, the average is 60. Assuming that the light transmission quantity for the underlying portion and the printed portion at the time of the multiple feed may become a half compared with the single feed under such a condition, the average of the variations is 30. At this time, the variation in the light transmission quantity of the underlying portion is 50 and that of the printed portion is 10. This example 2 is for the case where the level of darkness of the printed portion of the prints is higher than that in the example 1.

EXAMPLE 3

As shown in FIG. 14, if the frequency at the light transmission quantity of 100 for the underlying portion of the prints is 80 and the frequency at the light transmission quantity of 40 for the printed portion of the prints is 20 at the time of the single feed, the average is 88. Assuming that the light transmission quantity for the underlying portion and the printed portion at the time of the multiple feed may become a half compared with the single feed under such a condition, the average of the variations is 44. At this time, the variation in the light transmission quantity of the underlying portion is 50 and that of the printed portion is 20. This example 3 is for the case where the frequencies of the underlying portion and the printed portion of the prints are different.

EXAMPLE 4

As shown in FIG. 15, if the frequency at the light transmission quantity of 100 for the underlying portion of the prints is 60 and the frequency at the light transmission quantity of 40 for the printed portion of the prints is 40 at the time of the single feed, the average is 76. Assuming that the light transmission quantity for the underlying portion and the printed portion at the time of the multiple feed may become a half compared with the single feed under such a condition, the average of the variations is 38. At this time, the variation in the light transmission quantity of the underlying portion is 50 and that of the printed portion is 20. This example 4 is for the case where the frequency of the printed portion of the prints is closer to that of the underlying portion than it is in the example 3.

SUMMARY OF THE INVENTION

Thus, the above mentioned examples 1 to 4 (referring to FIGS. 12 to 15) show that the smaller the quantity of the light transmission becomes as the level of the darkness of the printed portion of the prints becomes high, the smaller the average of the light transmission quantity becomes. These also show that the average of the light transmission quantity becomes small as the rate of the frequencies of the printed portion of the prints becomes large.

On the other hand, these also show that, focusing on only the variation in the underlying portion of the prints, the variations at the time of the single feed and the multiple feed are same.

FIG. 16 shows a frequency distribution representative of the light transmission quantity (analog-to-digital (A/D) converted value) when the prints pass between the multiple feed sensors. FIG. 16 shows that a histogram representative of the frequency at each of the A/D converted values indicates the clear discrimination between the "underlying portion" enclosed with broken lines A and the "printed portion" enclosed with broken lines B.

It is an object of the present invention to provide a method and device for detecting multiple feed capable of improving the accuracy of multiple feed detection over that currently in use and to overcome difficulties of the prior art, particularly by focusing on that the variation in the light transmission quantity of the "underlying portion" of the prints is large at the time of the multiple feed.

To achieve the above object, according to an aspect of the present invention, there is provided a multiple feed detection device comprising: a sheet detector having a light emitting sensor and a light receiving sensor arranged in vicinity of a carriage path to detect quantity of light that has transmitted through a sheet; a memory which stores a predetermined sampling number of electric signals indicative of light quantity outputted from the sheet detector; and a processor which creates a histogram of the light quantity stored in the memory, obtains the light quantity corresponding to a maximum frequency for an underlying portion of sheets based on the created histogram, and detects a multiple feed of the sheets based on a variation in the light quantity of the maximum frequency.

In a preferred embodiment of the present invention, the processor scans frequencies from the light quantity indicative of a low level of darkness toward that indicative of a high level thereof and then detects a peak of the frequencies that satisfies a predetermined condition as the light quantity corresponding to the maximum frequency.

In a preferred embodiment of the present invention, the processor calculates a total sum of the frequencies corresponding to a predetermined number of the light quantities adjacent to a light quantity of interest, and detects one of the light quantities adjacent to the light quantity of interest as the light quantity corresponding to the maximum frequency if the total sum of the frequencies reaches a value which is a certain ratio of the predetermined sample value.

In a preferred embodiment of the present invention, the processor, at the time of feeding of a first sheet, regards a value that is a certain ratio of the light quantity corresponding to the maximum frequency as a reference value for detecting the multiple feed of the sheets, and at the time of feeding of a second or successive sheet, regards the light quantity corresponding to the maximum frequency as a comparison value and compares the comparison value with the reference value thereby to detect the multiple feed of the sheets.

To achieve the above object, according to another aspect of the present invention, there is provided a multiple feed detection method comprising the steps of: arranging a sheet detector having a light emitting sensor and a light receiving sensor in vicinity of a carriage path to detect quantity of light that has transmitted through a sheet; storing a predetermined sampling number of electric signals indicative of light quantity outputted from the sheet detector in a memory; creating a histogram of the light quantity stored in the memory; detecting the light quantity corresponding to a maximum frequency for an underlying portion of sheets based on the created histogram; and detecting a multiple feed of the sheets based on a variation in the light quantity of the maximum frequency.

In a preferred embodiment of the present invention, frequencies are scanned from the light quantity indicative of a low level of darkness toward that indicative of a high level thereof, and then a peak of the frequencies that satisfies a predetermined condition is detected as the light quantity corresponding to the maximum frequency.

In a preferred embodiment of the present invention, a total sum of the frequencies corresponding to a predetermined number of the light quantities adjacent to a light quantity of interest is calculated, and if the total sum of the frequencies reaches a value which is a certain ratio of the predetermined sample value, then one of the light quantities adjacent to the light quantity of interest is detected as the light quantity corresponding to the maximum frequency.

In a preferred embodiment of the present invention, at the time of feeding of a first sheet, a value that is a certain ratio of the light quantity corresponding to the maximum frequency is regarded as a reference value for detecting the multiple feed of the sheets, and at the time of feeding of a second or successive sheet, the light quantity corresponding to the maximum frequency is regarded as a comparison value and then the comparison value is compared with the reference value thereby to detect the multiple feed of the sheets.

The nature, principle and utility of the invention will become more apparent from the following detailed description when read in conjunction with the accompanying drawings.

BRIEF DESCRIPTION OF THE DRAWINGS

In the accompanying drawings:

FIG. 5 shows a diagram of the sum of the frequencies for calculating reference values for the case in FIG. 4;

FIG. 7 shows a diagram of the sum of the frequencies for calculating reference values for the case in FIG. 6;

DESCRIPTION OF THE PREFERRED EMBODIMENTS

Figure 1:
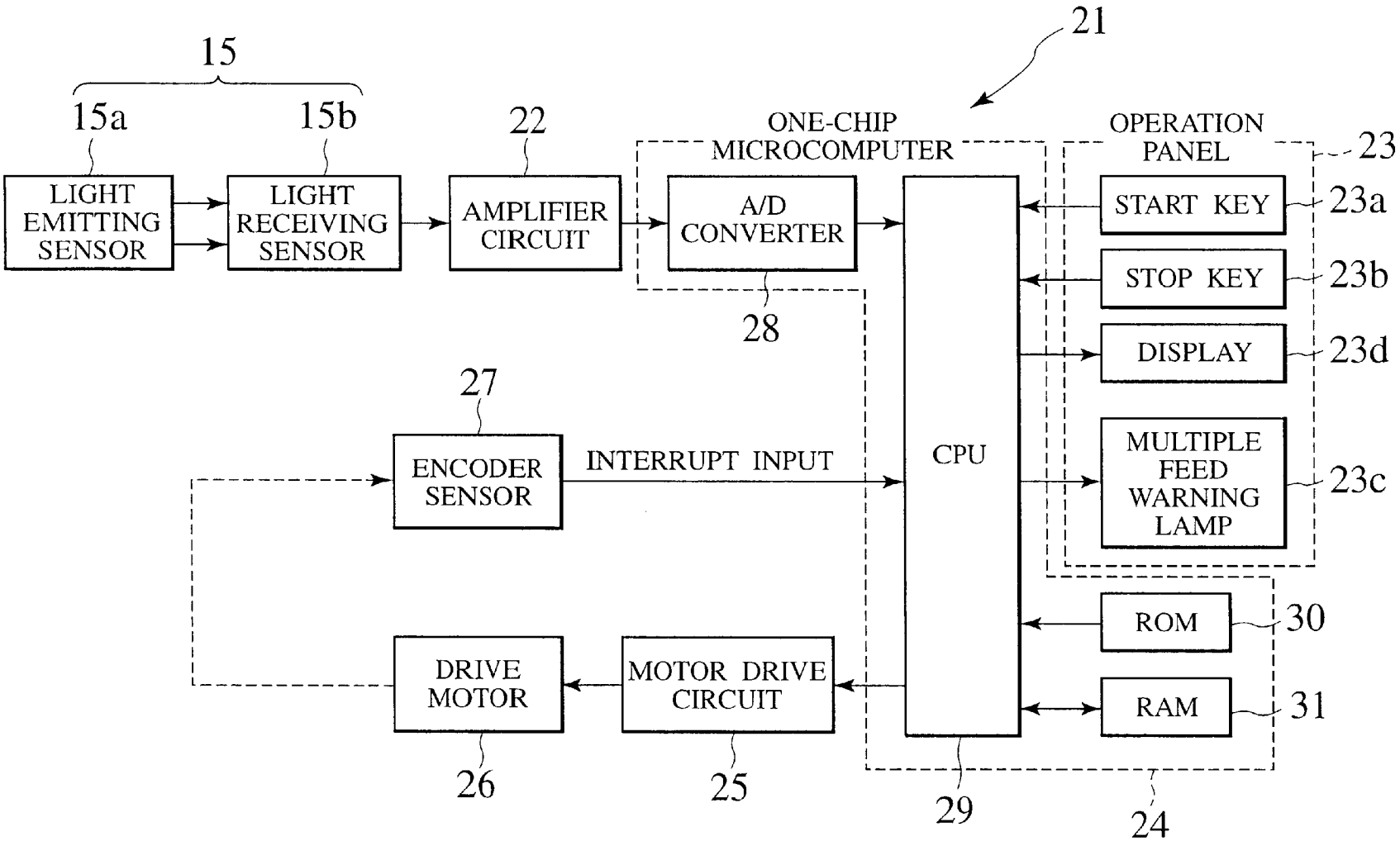
FIG. 1 shows a block diagram presenting the case where a multiple feed detection device of the present invention is applied to a collator.
Figure 8:
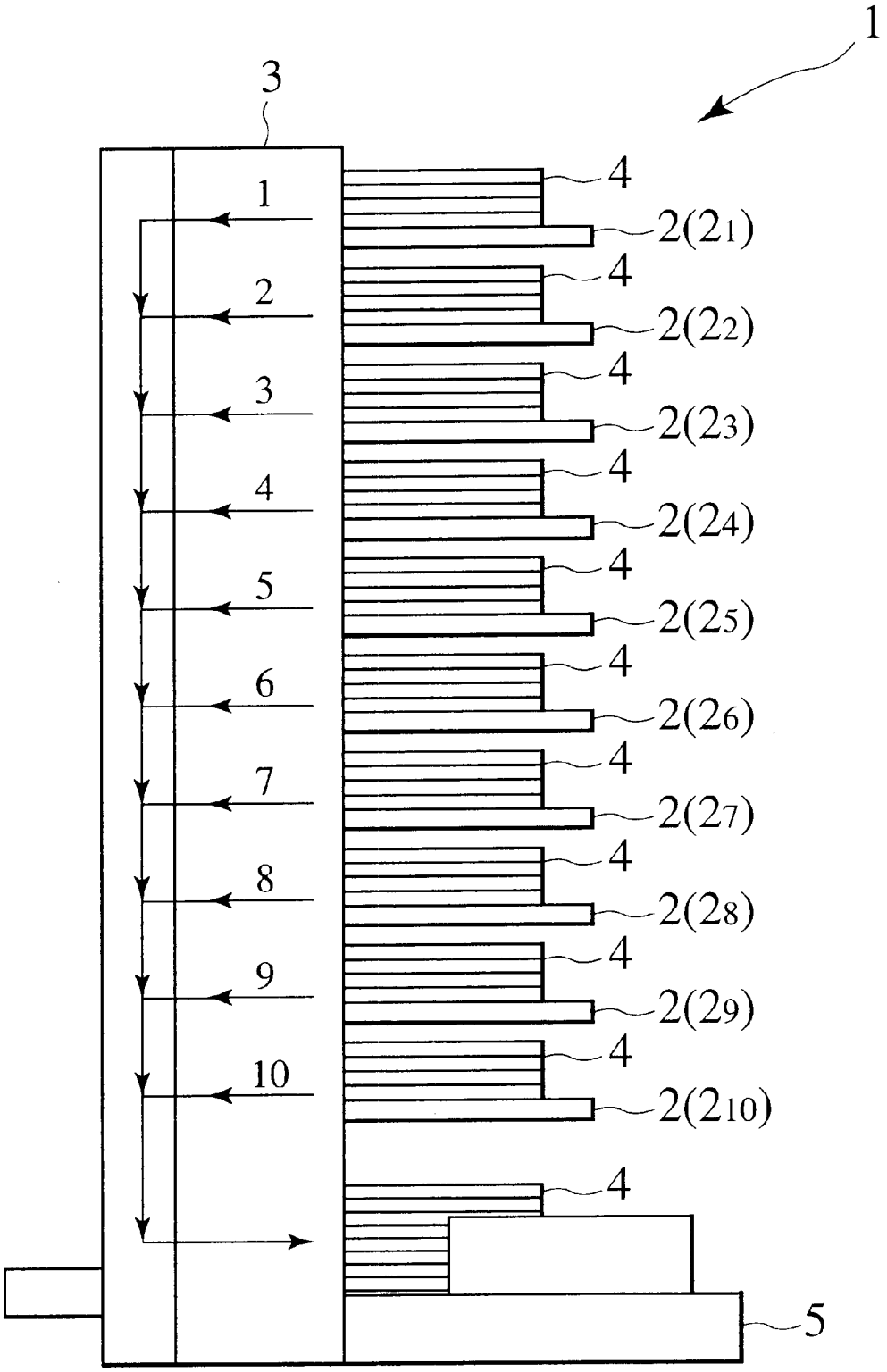
FIG. 8 shows an external view illustrating an entire collator.
Figure 9A:
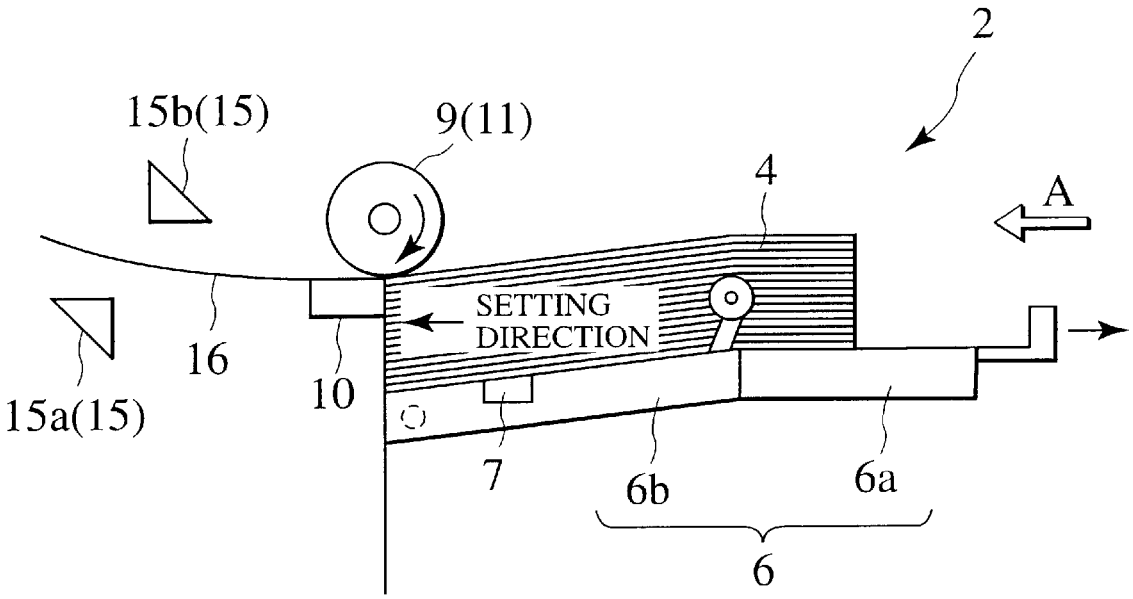
FIG. 9A shows a side view of each bin of the collator in FIG. 8.
Figure 9B:
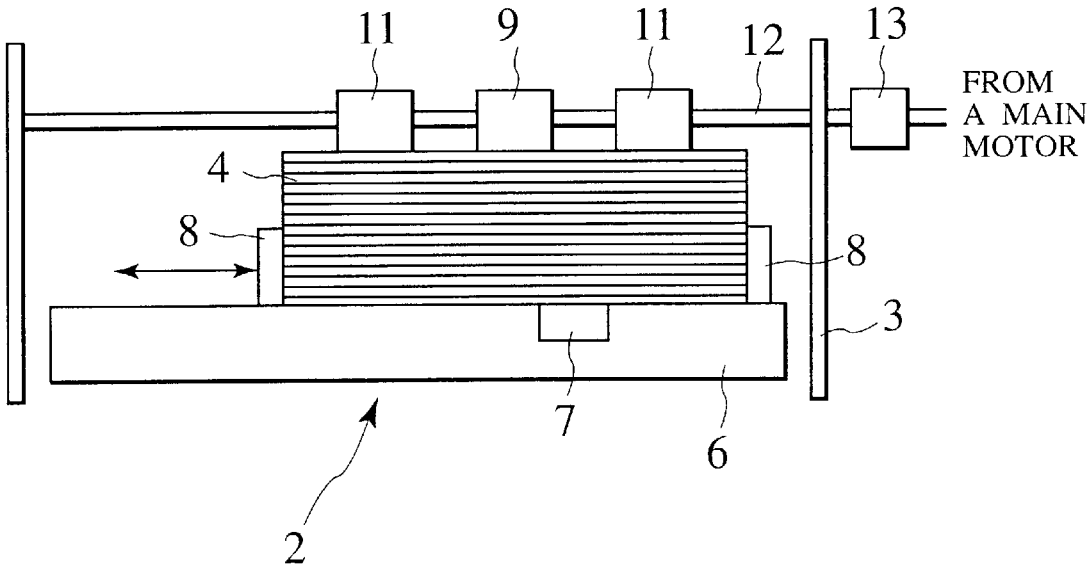
FIG. 9B shows a view illustrating each bin as viewed in the direction indicated by the arrow A in FIG. 9A.
Figure 10A:
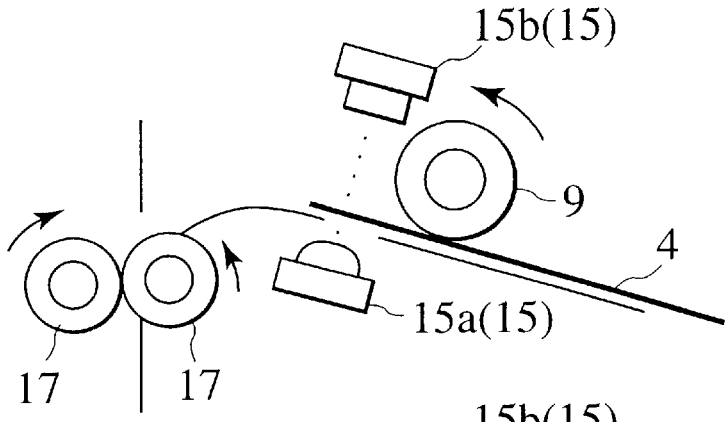
FIGS. 10A to 10D show the successive carriage states of the prints when they are fed from each of the bins into an apparatus body.
Figure 10B:
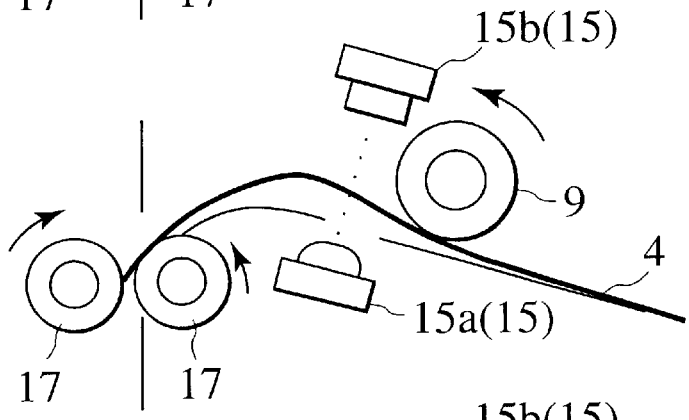
Figure 10C:
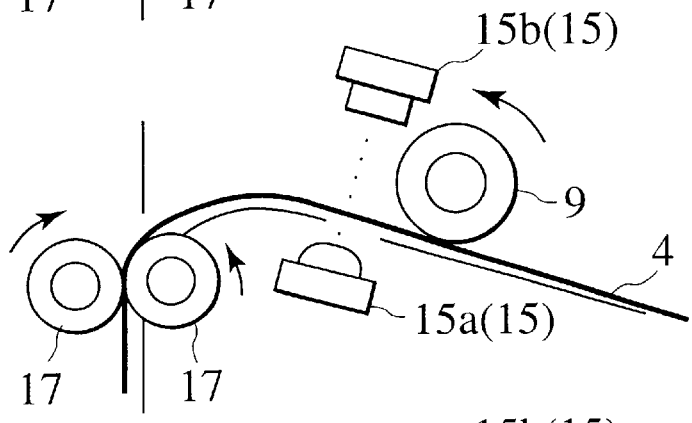
Figure 10D:
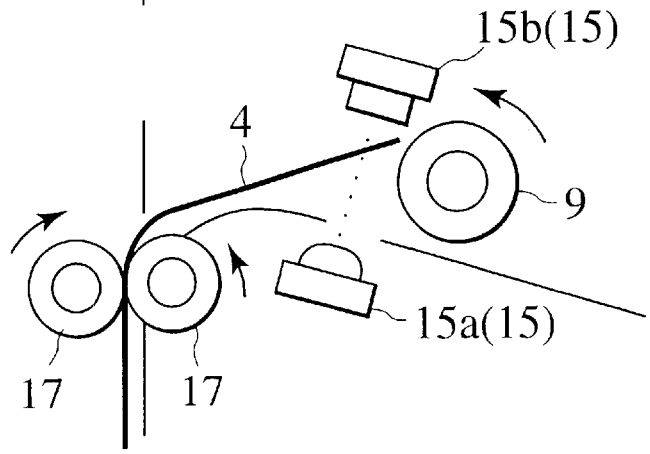
Figure 11:
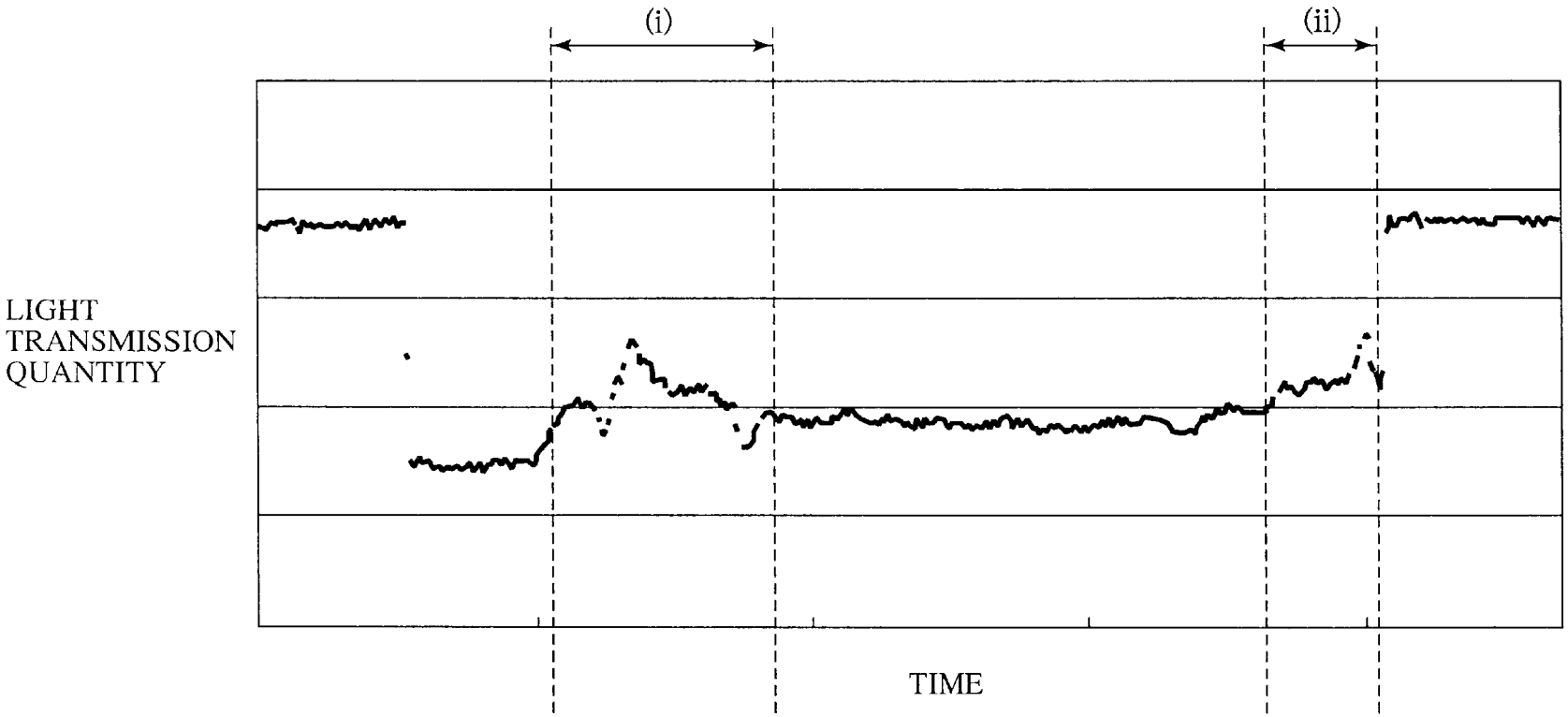
FIG. 11 shows a view illustrating an example of the light transmission quantity of the prints at the time of the sheet feed.
Figure 12:
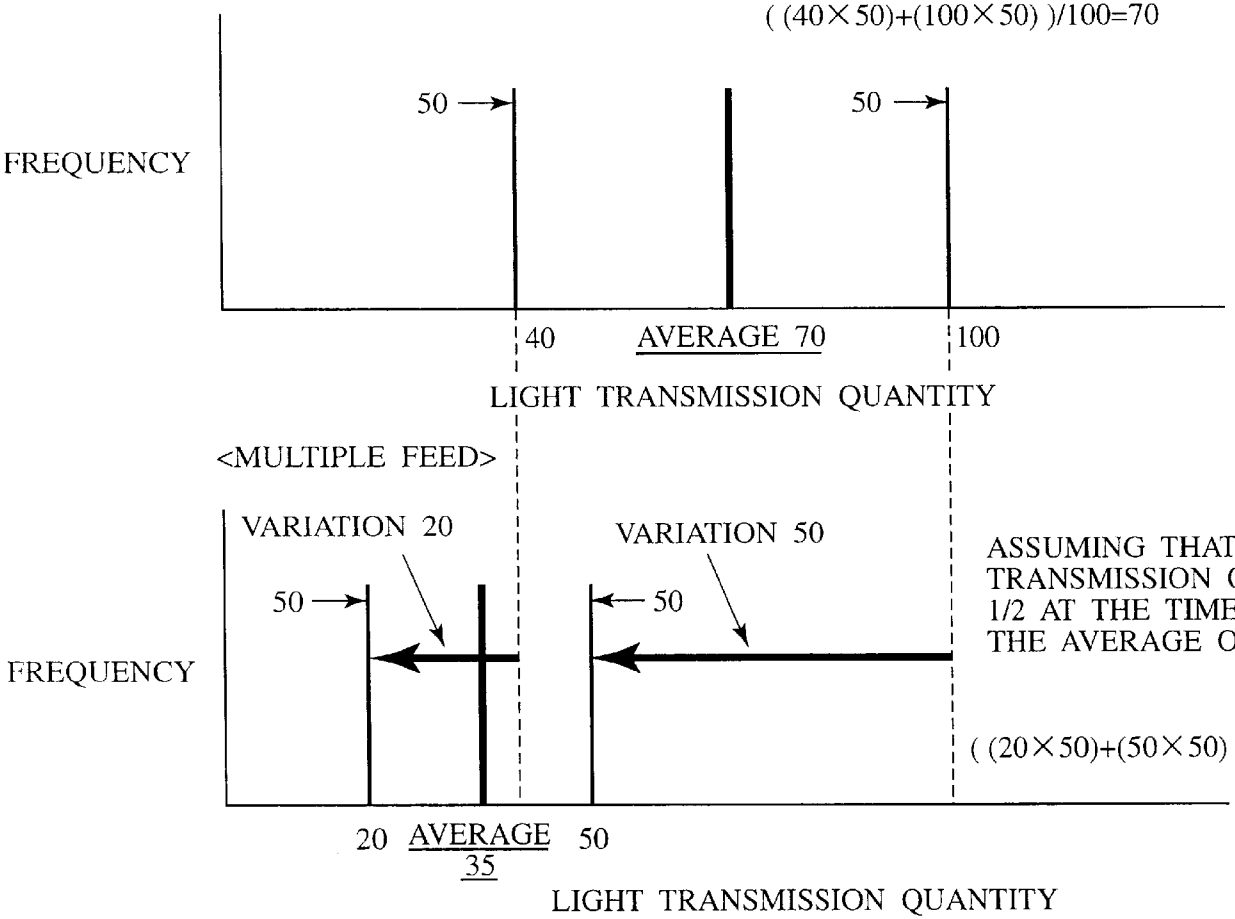
FIG. 12 shows a view illustrating the relationship between the light transmission quantity and the frequency at the time of the single feed and the multiple feed when the frequencies of the underlying portion and the printed portion are identical.
Figure 13:
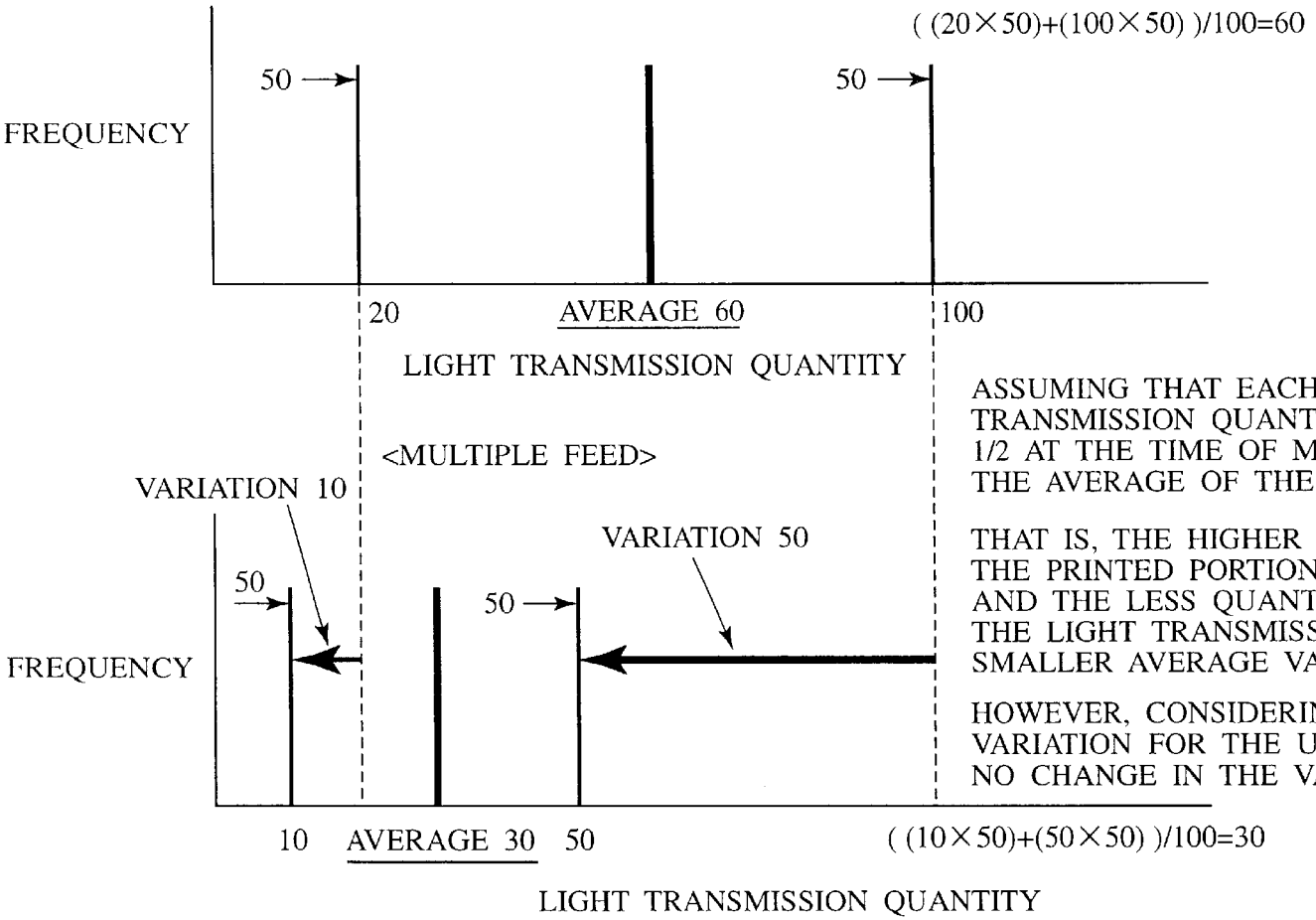
FIG. 13 shows a view illustrating the relationship between the light transmission quantity and the frequency at the time of the single feed and the multiple feed when the frequencies of the underlying portion and the printed portion are identical but the level of the darkness of the printed portion is higher than that in FIG. 12.
Figure 14:
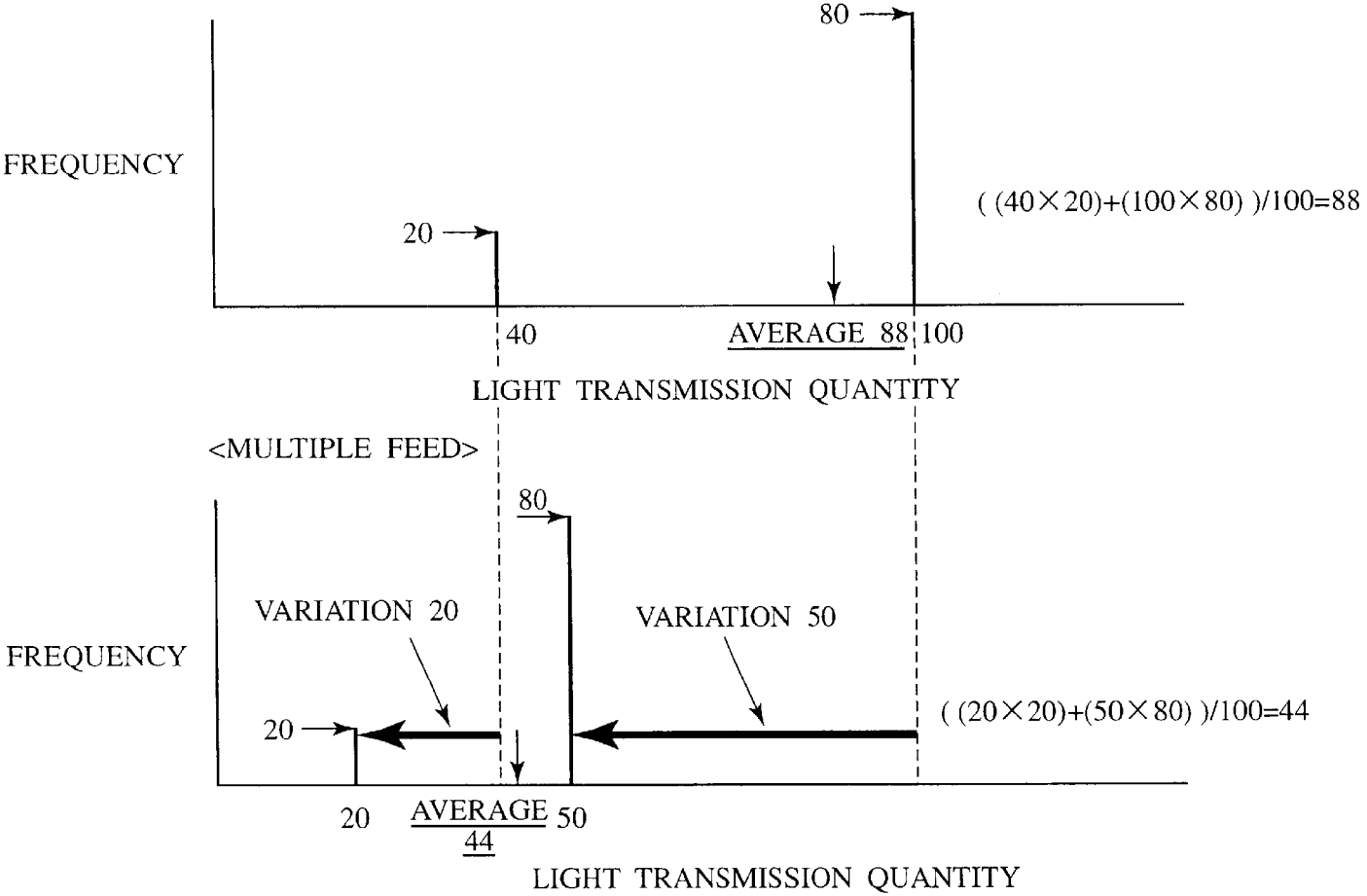
FIG. 14 shows a view illustrating the relationship between the light transmission quantity and the frequency at the time of the single feed and the multiple feed when the frequencies of the underlying portion and the printed portion are different from each other.
Figure 15:
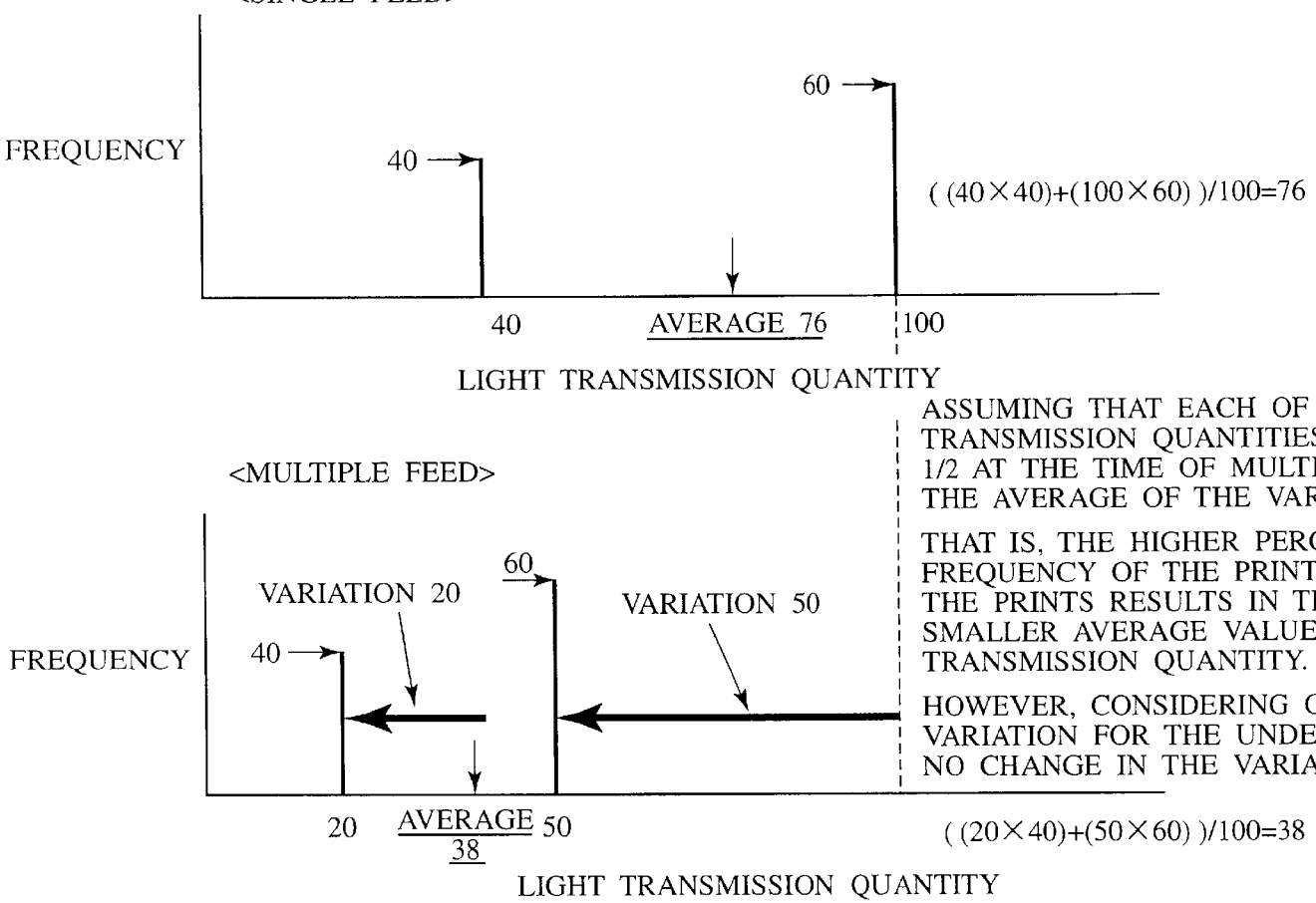
FIG. 15 shows a view illustrating the relationship between the light transmission quantity and the frequency at the time of the single feed and the multiple feed when the frequency of the printed portion is closer to that of the underlying portion than it is in FIG. 14.
Figure 16:
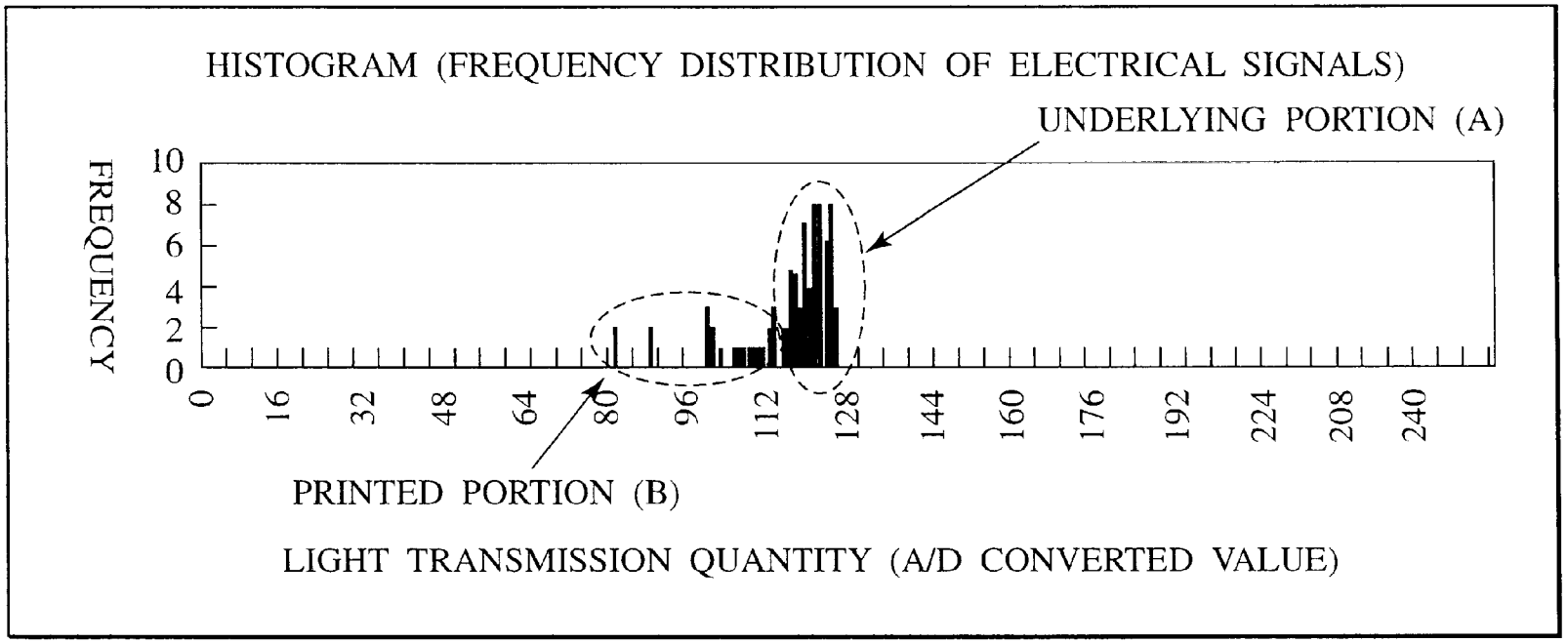
FIG. 16 shows a view illustrating an example of the relationship between the light transmission quantity (A/D converted value) and the frequency when the prints are fed.

FIG. 1 shows a block diagram illustrating the case where a multiple feed detection device of the invention is applied to the collator shown in FIGS. 8 to 10.

As shown in FIG. 1, a multiple feed detection device 21 comprises a multiple feed sensor 15, an amplifier circuit 22, an operation panel 23, a microcomputer 24, a motor drive circuit 25, a drive motor 26, and encoder sensor 27.

The amplifier circuit 22 amplifies an electrical signal indicative of the light transmission quantity received from a light receiving sensor 15*b* of the multiple feed sensor 15 by a predetermined amplification factor and then supplies the signal to the microcomputer 24.

The operation panel 23 may include operation keys manipulated by a user, e.g., a start key 23*a* for designating the start of the collating operation and a stop key 23*b* for designating the stop of the collating operation. A multiple feed warning lamp 23*c*, which is lit when any multiple feed (that is, two or more sheets of the prints 4 are fed in the overlapped state) occurs, is provided on the operation panel 23. In addition, a display 23*d*, e.g., a liquid crystal display, for providing various displays such as a display of a message of the multiple feed warning is provided on the operation panel 23.

The microcomputer 24 as a processor is constituted of one-chip microcomputer comprising an A/D converter 28, CPU 29, and ROM 30 and RAM 31.

The A/D converter 28 converts the received signal from the amplifier circuit 22 to a digital signal corresponding to the analog signal, and supplies it to the CPU 29 as the light transmission quantity.

The CPU 29 includes a microprocessor and so on, and conducts a carriage control of the prints 4, setting of a sampling range, multiple feed detection of the prints 4 according to the flow diagrams shown in FIGS. 2 and 3 as explained later, etc. based on the information from the operation panel 23, the signal from the amplifier circuit 22, and the signal from the encoder sensor 27.

As explained in more detail, the CPU 29 samples the digital signal received from the A/D converter 28 at an input timing of the interrupt signal from the encoder sensor 27 within a previously set sampling range. The sampling range is set as the count number of pulses of the encoder sensor 27 from a reference point in time of detection of the front end of the prints 4 by the multiple feed sensor 15.

The CPU 29 issues commands for controlling the drive and stop of the drive motor 26 to the motor drive circuit 25 based on the operation signals from the start key 23*a* and the stop key 23*b* on the operation panel 23.

The CPU 29 has a sheet feed counter therein, and increments by one the counts in response to an interrupt signal received from the encoder sensor 27.

Figure 2:
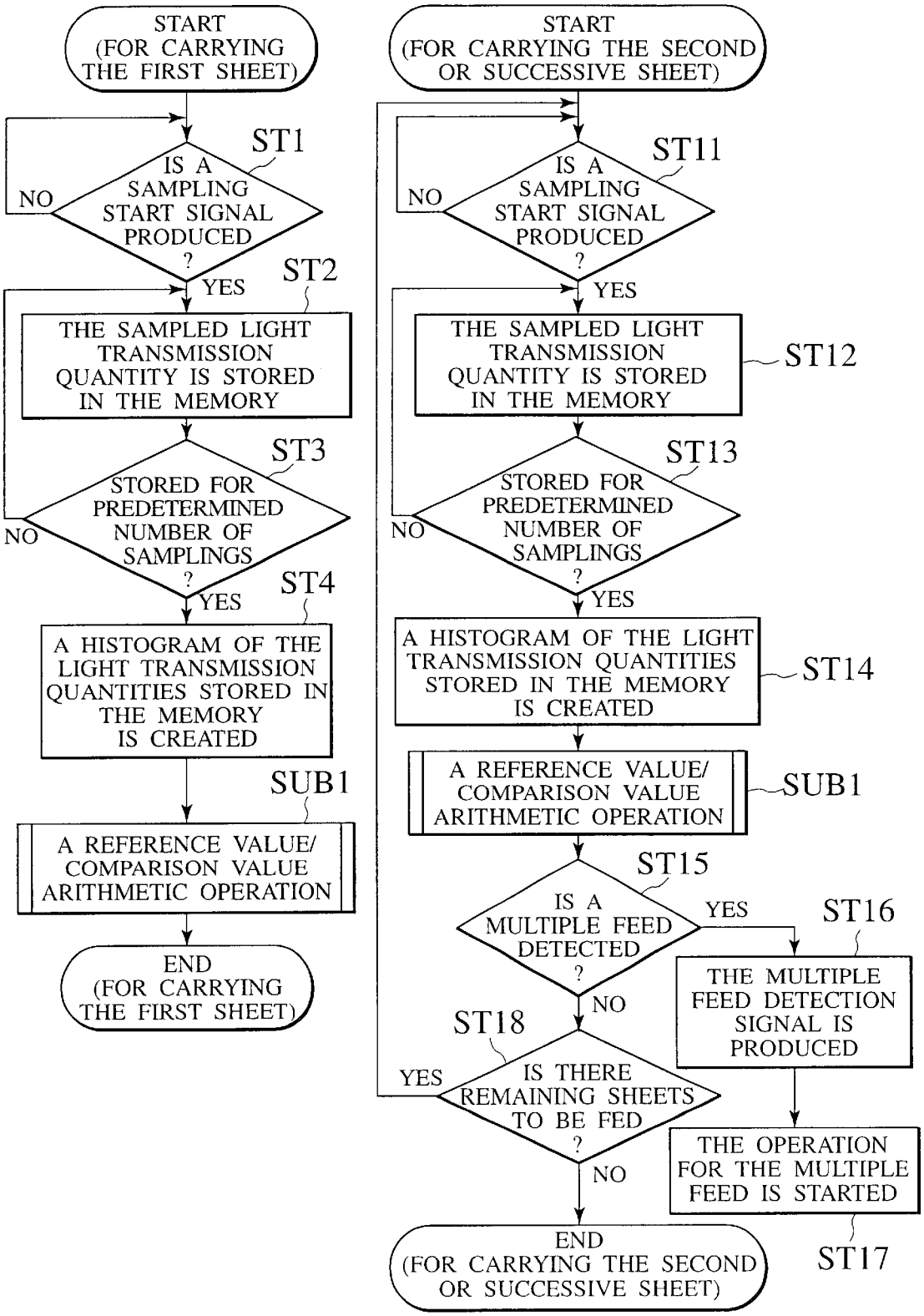
FIG. 2 shows a flow diagram presenting a sequence of multiple feed detection operation of the present invention.
Figure 3:
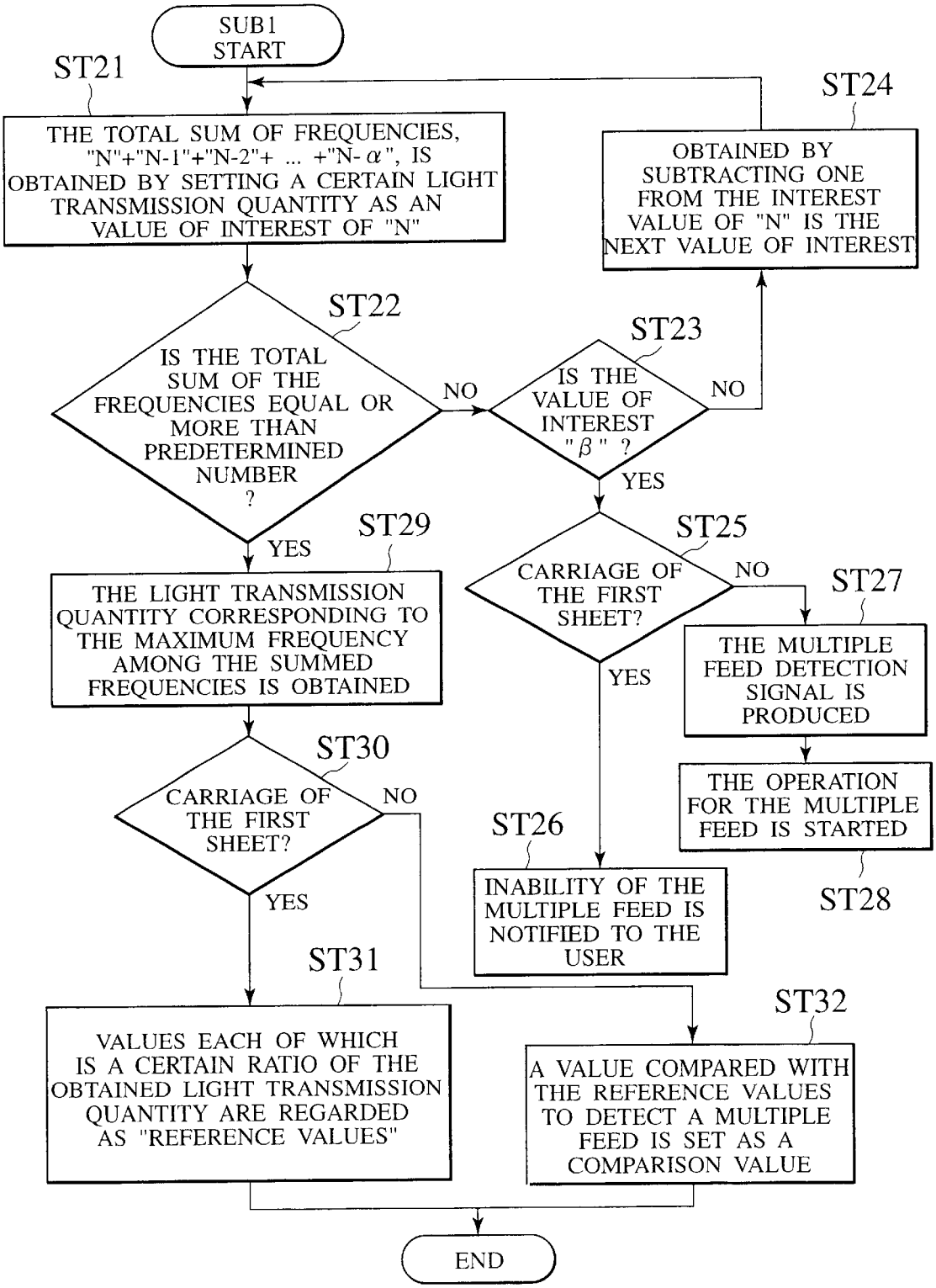
FIG. 3 shows a flow diagram presenting a sequence of arithmetic processes of a reference value/comparison value in FIG. 2.

The ROM 30 stores processing programs necessary for conducting a sequence of processes containing the processes shown in FIGS. 2 and 3 by the CPU 29, data of the sampling range in accordance with the size of the prints 4, etc.

The RAM 31 stores the sampling data for the first sheet of the prints 4 within the sampling range set by the CPU 29, and successively stores, by updating, the sampling data for the second or successive sheet of the prints 4 within the sampling range set by the CPU 29. The RAM 31 stores the counts by the sheet feed counter in the CPU 29.

The motor drive circuit 25 drives or stops the rotation of the drive motor 26 based on the commands issued by the CPU 29.

The encoder sensor 27 produces a one-shot pulse signal when the drive motor 26 rotates until a predetermined length of the prints 4 is fed. This one-shot pulse signal is supplied as an interrupt signal to the CPU 29.

Next, operations of the multiple feed detection device 21 will be explained with reference to the flow charts shown in FIGS. 2 and 3.

The processes of the flow charts shown in FIGS. 2 and 3 are respectively executed in each of the bins $\mathbf{2}_1$ to $\mathbf{2}_{10}$ under control of the CPU 29 in accordance with the processing programs of the ROM 30 when the prints 4 are fed from each of the bins $\mathbf{2}_1$ to $\mathbf{2}_{10}$ of the collator 1.

First of all, if the first sheet of the prints 4 is fed and the signal for starting sampling is produced (ST1-YES), sampling of the light transmission quantity of the prints 4 is started. That is, the pulse signals from the encoder sensor 27 are counted from a reference point in time when the multiple feed sensor 15 detects the front edge of the first sheet, and if the count reaches the value of the sampling start position, the light transmission quantity which is converted by the A/D converter 28 via the amplifier circuit 22 from the multiple feed sensor 15 is supplied to the CPU 29. The light transmission quantity is then stored in the RAM 31 (ST2).

The accuracy of the multiple feed detection improves as the total sampling number in such a sampling increases. However, limitations may be imposed in terms of the capacity of the RAM 31 or the arithmetic processing speed of the CPU 29. Without any problem on the capacity of the RAM 31 or the arithmetic processing speed of the CPU 29, shorter distances between samplings within the same sampling region allows the total sampling number to be increased. In contrast with this, with the small capacity of the RAM 31 and the low arithmetic processing speed of the CPU 29, the sampling distance may be wider.

Next, when the count of the pulse signals from the encoder sensor 27 reaches a value corresponding to the sampling end position and thus the light transmission quantities of the predetermined number of samplings are stored in the RAM 31 (ST3-YES), a histogram for determining the frequency of the light transmission quantities stored in the RAM 31 is created (ST4). After the histogram is created, the step is shifted to a reference value/comparison value arithmetic operation shown in FIG. 3 as will be mentioned later (SUB1).

Next, in the case that the second or successive sheet of the prints 4 is fed, similarly to the sheet feed of the first sheet, when the signal for starting sampling is produced (ST11-YES), sampling of the light transmission quantity of the sheet is started. That is, the pulse signals of the encoder sensor 27 are counted from a reference point in time when the multiple feed sensor 15 detects the front edge of the second or successive sheet, and if the count reaches the value of the sampling start position, the light transmission quantity which is converted by the A/D converter 28 via the amplifier circuit 22 from the multiple feed sensor 15 is supplied to the CPU 29. The light transmission quantity is then stored in the RAM 31 (ST12). Next, when the count of the pulse signals from the encoder sensor 27 reaches a value corresponding to the sampling end position and thus the light transmission quantities of the predetermined number of samplings are stored in the RAM 31 (ST13-YES), a histogram for determining the frequency of the light transmission quantities stored in the RAM 31 is created (ST14). After the histogram is created, the step is shifted to a reference value/comparison value arithmetic operation shown in FIG. 3 as will be mentioned later (SUB1).

A plurality of peaks of frequencies exist in the histogram produced in the step of ST4 or ST14, affected by the sheet passing position between the light emitting sensor 15*a* and the light receiving sensor 15*b* of the multiple feed sensor 15 and affected by the printed portion on the sheet.

In the reference value/comparison value arithmetic operation in the step of SUB1, in order to obtain a peak of frequency corresponding to the underlying portion of the sheet where the variation in the light transmission quantity is large at the time of the multiple feed from the plurality of peaks of frequency, a certain light transmission quantity searched from an end having large value in the quantity (namely, small value in darkness) is set to a value of interest of "n", and the total sum of frequencies relative to the light transmission quantities having the total number of a $\alpha+1$, namely "n —1", "n–2", . . . ,"n–$\alpha$a", which line up side by side toward a direction of small in quantity from the value of interest of "n", is obtained (ST21).

As the value of interest of "n", the light transmission quantity when no sheet is fed may be selected, otherwise a value that is smaller by a predetermined value than the light transmission quantity when no sheet is fed may be selected with considering reduction in time of arithmetic processing. The value of $\alpha$ is a predetermined integer value ("4" for example). The smaller this value becomes, the shorter the arithmetic processing time for one processing becomes.

Then, if the total sum is less than a predetermined value that is a certain ratio of the total sampling number (ST22-NO), and the value of interest is not "$\beta$" (ST23-NO), then a value obtained by subtracting "1" from the value of interest of "n" is set to be the next value of interest (ST24), and the process goes back to ST21 to obtain the total sum of the frequencies.

If the value of interest is "$\beta$" (ST23-YES), and the carriage is a carriage of the first sheet of the prints 4 (ST25-YES), then the detection of multiple feed cannot be conducted, which is notified to the user (ST26). The value of "$\beta$" is set to a predetermined value which is a certain ratio (e.g., 10%) of the light transmission quantity at the time of a non-sheet feed. On the other hand, if the carriage is a carriage of the second or successive sheet (ST25-NO), then a multiple feed detection signal is produced from the CPU 29 (ST27) to start the operations for coping with the multiple feed (ST28). For example, after collated prints including the multiply fed prints are discharged onto the sheet discharge tray 5, the sheet feeds from all the bins 2 are stopped, and the multiple feed warning lamp 23*c* on the operation panel 23 is lit to notify the occurrence of the multiple feed to the user. At this time, it may be also notified to the user which bin is related with the multiple feed.

If the total sum of the frequencies is equal or more than the predetermined value which is a certain ratio of the total sampling number (ST22-YES), then a light transmission quantity which corresponds to the maximum frequency among the summed frequencies is obtained (ST29).

The maximum frequency among the summed frequencies is then regarded as the light transmission quantity of the underlying portion of the prints 4. If the carriage is a carriage for the first sheet of the sheets 4 (ST30-YES), reference values for detecting a multiple feed are obtained from the obtained light transmission quantity (ST31). Each of the reference values is a value which is a certain ratio of the light transmission quantity which corresponds to the maximum frequency among the summed frequencies. For example, the reference values may be values which are 75% and 150% of the light transmission quantity corresponding to the maximum frequency among the summed frequencies.

If the carriage is a carriage of the second or successive sheet of the prints (ST30-NO), then the light transmission quantity which corresponds to the maximum frequency among the summed frequencies is regarded as a comparison value (a value to be compared with the reference values) (ST32), and then the comparison value is compared with the reference values to detect a multiple feed. If a multiple feed is detected (ST15-YES), the multiple feed detection signal is produced from the CPU 29 (ST16) and the operation for the multiple feed is started (ST17). For example, after collated prints including the multiply fed prints are discharged onto the sheet discharge tray 5, the sheet feeds from all the bins 2 are stopped, and the multiple feed warning lamp 23*c* on the operation panel 23 is lit to notify the occurrence of the multiple feed to the user. At this time, it may be also notified to the user which bin is related with the multiple feed. If no multiple feed is detected (ST15-NO) and the prints 4 to be fed remain (ST18-YES), the process returns to the step ST11.

Next, more detailed numerical examples on the reference value/comparison value arithmetic operation will be explained with reference to FIGS. 4 to 7.

Figure 4:
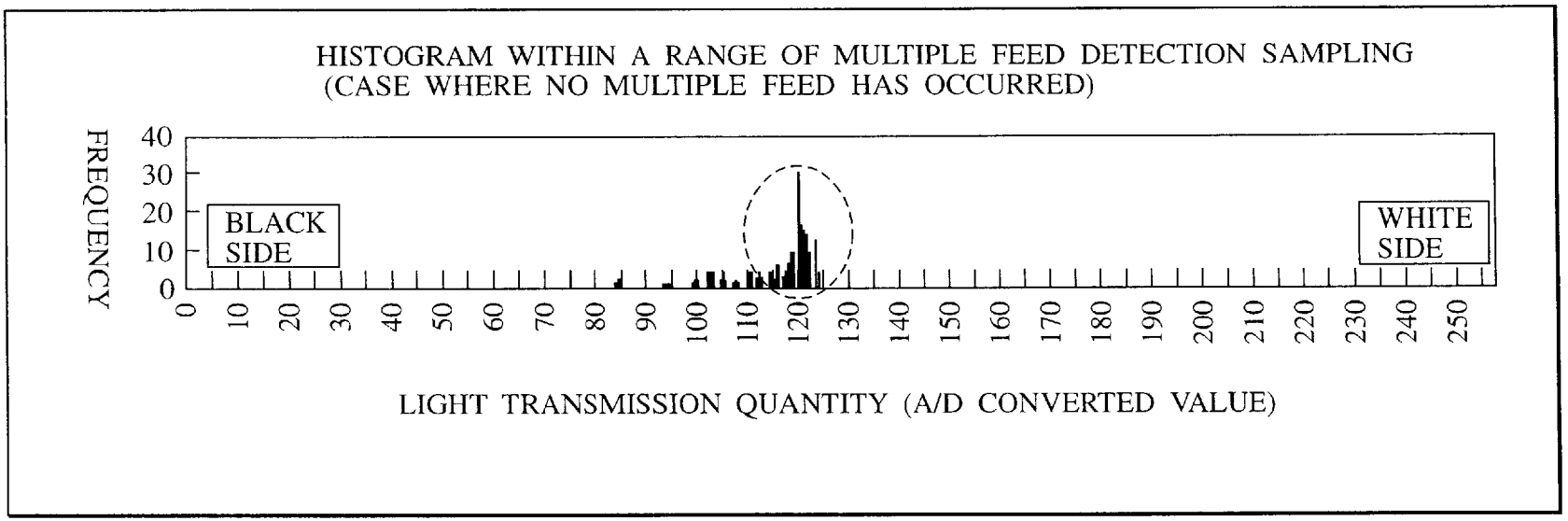
FIG. 4 shows a view illustrating an example of a histogram within a sampling range of the multiple feed detection where no multiple feed has occurred.
Figure 6:
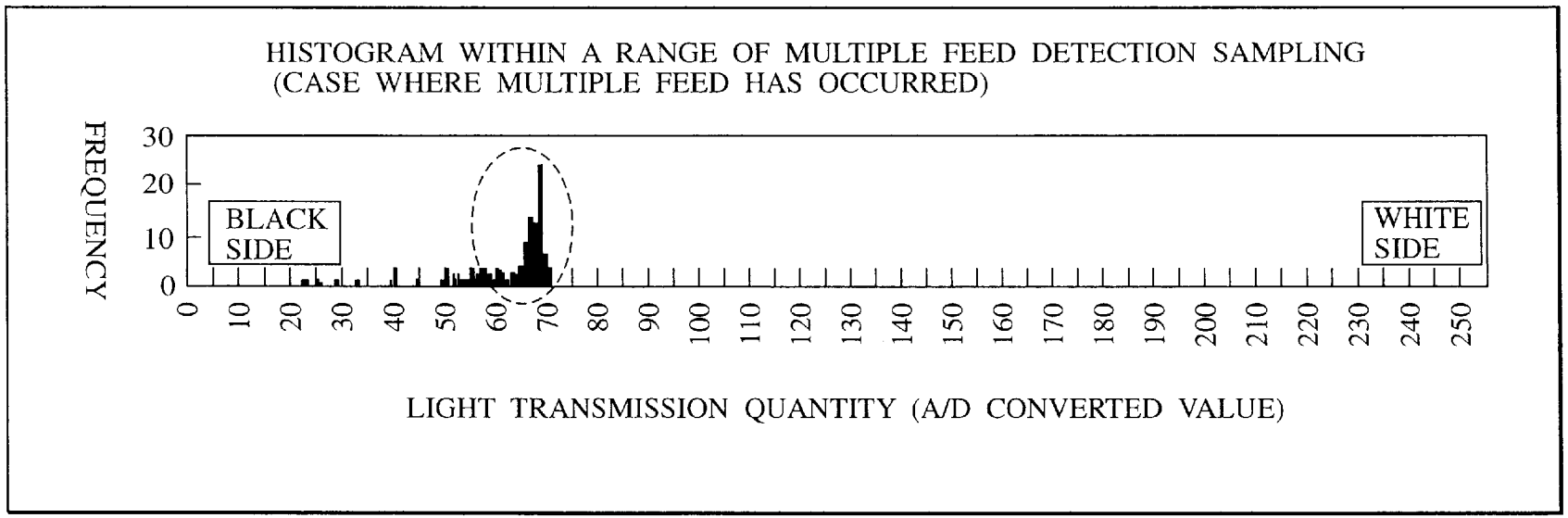
FIG. 6 shows a view illustrating an example of a histogram within a sampling range of the multiple feed detection where a multiple feed has occurred.

FIG. 4 shows an example of a histogram in a range of multiple feed detection sampling where no multiple feed has occurred, FIG. 5 shows a view presenting the sum of frequencies for calculating a comparison value for the case in FIG. 4, FIG. 6 shows an example of a histogram in a range of the multiple feed detection sampling where a multiple feed has occurred, and FIG. 7 shows a view presenting the sum of frequencies for calculating a comparison value for the case in FIG. 6.

In the following example, it is assumed that $\alpha$=4 and the predetermined number is "40" which is 40 percents of the total sampling number "100".

Now, the first sheet of the prints 4 is fed, and then the histogram shown in FIG. 4 is created in the step ST4 in FIG. 2. Then, as shown in FIG. 5, determining that the light transmission quantity "124" is the value of interest "n", then the total sum of the frequencies adjacent to the value of interest "n", which are n–1=123, n–2=122, n–3=121, and n–4=120, is calculated. Further, since the total sum "52" of the frequencies at this time exceeds the predetermined number "40" obtained from the total sampling number, the light transmission quantity "120" having the maximum frequency among the summed frequencies is obtained. Then, the value "90" which is 75 percents of the light transmission quantity "120" and the value "180" which is 150 percents thereof are calculated as the reference values.

Next, the second sheet of the prints 4 is fed, and then the histogram shown in FIG. 6 is created in the step ST14 in FIG. 2. Then, as shown in FIG. 7, determining that the light transmission quantity "71" is the value of interest "n", then the total sum of the frequencies adjacent to the value of interest "n", which are n–1=70, n–2=69, n–3=68, and n–4 67, is calculated. Further, since the total sum "42" of the frequencies at this time exceeds the predetermined number "40" obtained from the total sampling number, the light transmission quantity "68" having the maximum frequency among the summed frequencies is calculated as a comparison value. The comparison value "68" is then compared with the reference values of "90" and "180" which are calculated at the time of the feed of the first sheet of the prints 4. In this case, it is decided that the multiple feed occurs since the comparison value "68" is smaller than the reference value Therefore, according to the embodiments of the present invention, a histogram for obtaining the frequency of the light transmission quantity of the prints is created, and based on the frequencies distribution, a peak of the frequencies corresponding to the underlying portion of the prints is detected, and then the variation in the light transmission quantity corresponding to the maximum frequency is used for the multiple feed detection among the detected frequencies of the peak. For this reason, the rate of successful multiple feed detection increases as compared with the conventional methods.

Although, in the embodiments of the invention, the multiple feed sensor 15 is a pair of light emitting and receiving sensors of light transmission type arranged to be opposed to each other and to sandwich the prints 4 carried along the carriage path 16, the invention is not limited thereto and a pair of light emitting and receiving sensors of reflection type arranged in one side of the carriage can be also adapted. At this time, of course, the value of electrical signals analog-to-digital converted is not the light transmission quantity but the light reflection quantity.

In addition, sheets subjected to the multiple feed detection are not, of course, limited to the prints but include non-printed papers for purpose of inserting papers.

Figure 17:
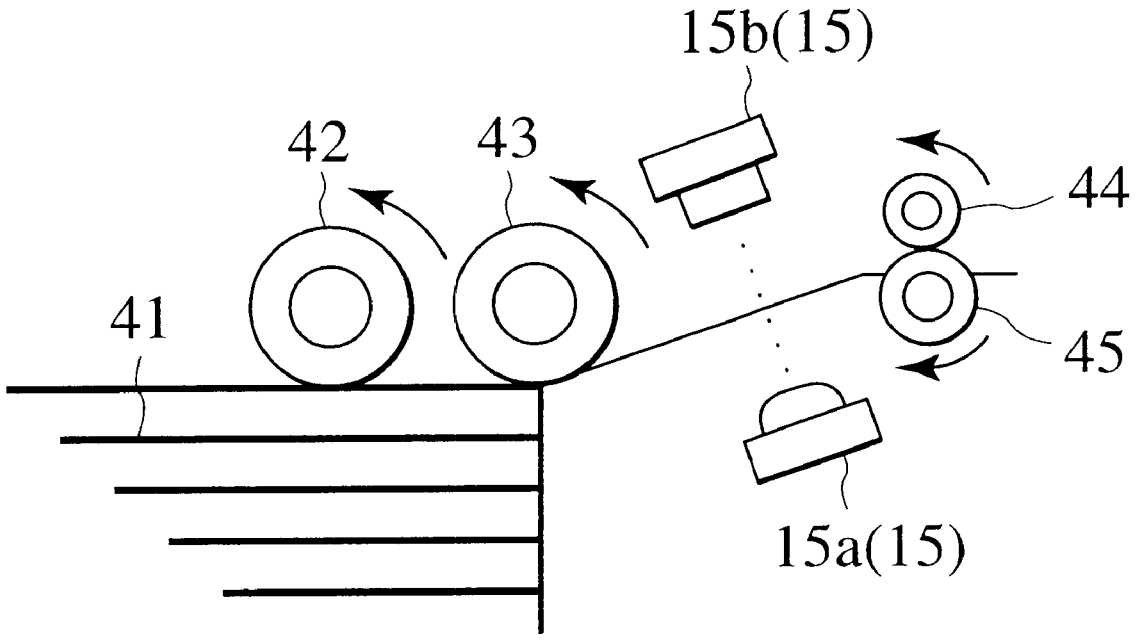
FIG. 17 shows a view illustrating another example of a sheet feed mechanism to which the present invention is applied.

Although the embodiments of the present invention have been explained by an example in use of an collator, they should not be limited only to this constitution, but can be used in a sheet feed mechanism provided for printing machines, copying machines, etc. For example, as shown in FIG. 17, they can be also used in a sheet feed mechanism in which layered prints 41 are separated one by one from the top by a scraper roller 42 and a pickup roller 43, and each of the separated prints 41 is carried between a printing drum around which perforated stencil is wound (not shown) and a press roller through a guide roller 44 and a timing roller 45. In this case, multiple feed sensor 15 (a light emitting sensor 15a, a light receiving sensor 15*b*) is positioned around the carriage path 46 between the pickup roller 43 and the timing roller 45, and the multiple feed detection is conducted for the prints 41 passing on the carriage path 46.

As explained above, according to the present invention, a histogram for obtaining the frequency of the light transmission quantity of the prints is created, and based on the frequencies distribution, a peak of the frequencies corresponding to the underlying portion of the prints is detected, and then the variation in the light transmission quantity corresponding to the maximum frequency is used for the multiple feed detection among the detected frequencies of the peak. Therefore, the rate of successful multiple feed detection increases as compared with the conventional methods.

It should be understood that many modifications and adaptations of the invention will become apparent to those skilled in the art and it is intended to encompass such obvious modifications and changes in the scope of the claims appended hereto.

What is claimed is:

1. A multiple feed detection device comprising:

a sheet detector having a light emitting sensor and a light receiving sensor arranged in vicinity of a carriage path to detect quantity of light that has transmitted through a sheet;

a memory which stores a predetermined sampling number of electric signals indicative of light quantity outputted from the sheet detector; and a processor which creates a histogram of the light quantity stored in said memory, obtains the light quantity corresponding to a maximum frequency for an underlying portion of sheets based on the created histogram, and detects a multiple feed of said sheets based on a variation in the light quantity of the maximum frequency.

2. The multiple feed detection device according to claim 1, wherein said processor scans frequencies from the light quantity indicative of a low level of darkness toward that indicative of a high level thereof and then detects a peak of the frequencies that satisfies a predetermined condition as the light quantity corresponding to the maximum frequency.

3. The multiple feed detection device according to claim 2, wherein said processor calculates a total sum of the frequencies corresponding to a predetermined number of the light quantities adjacent to a light quantity of interest, and detects one of the light quantities adjacent to the light quantity of interest as the light quantity corresponding to the maximum frequency if the total sum of the frequencies reaches a value which is a certain ratio of the predetermined sample value.

4. The multiple feed detection device according to claim 3, wherein said processor, at the time of feeding of a first sheet, regards a value that is a certain ratio of the light quantity corresponding to the maximum frequency as a reference value for detecting the multiple feed of said sheets, and at the time of feeding of a second or successive sheet, regards the light quantity corresponding to the maximum frequency as a comparison value and compares the comparison value with the reference value thereby to detect the multiple feed of said sheets.

5. A multiple feed detection method comprising the steps of:

arranging a sheet detector having a light emitting sensor and a light receiving sensor in vicinity of a carriage path to detect quantity of light that has transmitted through a sheet;

storing a predetermined sampling number of electric signals indicative of light quantity outputted from the sheet detector in a memory;

creating a histogram of the light quantity stored in said memory;

detecting the light quantity corresponding to a maximum frequency for an underlying portion of sheets based on the created histogram; and detecting a multiple feed of said sheets based on a variation in the light quantity of the maximum frequency.

6. The multiple feed detection method according to claim 5, wherein frequencies are scanned from the light quantity indicative of a low level of darkness toward that indicative of a high level thereof, and then a peak of the frequencies that satisfies a predetermined condition is detected as the light quantity corresponding to the maximum frequency.

7. The multiple feed detection method according to claim 6, wherein a total sum of the frequencies corresponding to a predetermined number of the light quantities adjacent to a light quantity of interest is calculated, and if the total sum of the frequencies reaches a value which is a certain ratio of the predetermined sample value, then one of the light quantities adjacent to the light quantity of interest is detected as the light quantity corresponding to the maximum frequency.

8. The multiple feed detection method according to claim 7, wherein, at the time of feeding of a first sheet, a value that is a certain ratio of the light quantity corresponding to the maximum frequency is regarded as a reference value for detecting the multiple feed of said sheets, and at the time of feeding of a second or successive sheet, the light quantity corresponding to the maximum frequency is regarded as a comparison value and then the comparison value is compared with the reference value thereby to detect the multiple feed of said sheets.

* * * * *